US006746112B2

(12) United States Patent
Roof

(10) Patent No.: US 6,746,112 B2
(45) Date of Patent: Jun. 8, 2004

(54) REDUCED LEAKAGE INK CONTAINER OPENING

(75) Inventor: Bryan J. Roof, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/264,143

(22) Filed: Oct. 3, 2002

(65) Prior Publication Data

US 2004/0066434 A1 Apr. 8, 2004

(51) Int. Cl.[7] ..... M41J 2/175
(52) U.S. Cl. ..... 347/86
(58) Field of Search ..... 347/84, 85, 86, 347/87

(56) References Cited

U.S. PATENT DOCUMENTS

| | | | | |
|---|---|---|---|---|
| 4,849,774 A | | 7/1989 | Endo et al. | 346/140 |
| 5,365,260 A | | 11/1994 | Kitani et al. | 347/87 |
| 5,365,262 A | | 11/1994 | Hattori et al. | 347/87 |
| 5,608,437 A | | 3/1997 | Iwata et al. | 347/86 |
| 5,742,312 A | | 4/1998 | Carlotta | 347/87 |
| 5,764,259 A | | 6/1998 | Nakajima | 347/86 |
| 5,940,104 A | | 8/1999 | Karita et al. | 347/87 |
| 6,074,050 A | | 6/2000 | Perez et al. | 347/86 |
| 6,123,420 A | | 9/2000 | Higuma et al. | 347/86 |
| 6,145,974 A | * | 11/2000 | Shinada et al. | |
| 6,250,749 B1 | | 6/2001 | Merz et al. | 347/86 |
| 6,264,319 B1 | | 7/2001 | Altfather et al. | 347/86 |
| 6,280,024 B1 | | 8/2001 | Miyazawa et al. | 347/86 |

* cited by examiner

*Primary Examiner*—Anh T. N. Vo
(74) *Attorney, Agent, or Firm*—David J. Arthur

(57) ABSTRACT

A fluid container, particularly a replaceable ink container for an ink jet printer, and the method for opening that container reduce the likelihood of ejecting ink into the environment when a user opens the container. The ink container includes a housing formed of several container walls, with a fluid port through one of the container walls. An expansion element formed of a deformable wall portion of one of the container walls has an opening element attached to it so that the expansion element can be moved from an inner position to an outer position to expand the volume of the interior of the housing, thus lowering the pressure in the interior of the housing. The user opens a vent opening after expanding the expansion element to equalize the pressure in the interior of the ink container and the ambient external environment before opening the fluid port.

19 Claims, 6 Drawing Sheets

REDUCED LEAKAGE INK CONTAINER OPENING

BACKGROUND

The present invention relates to fluid containers, such as replaceable ink tanks for ink jet printers. In particular, the invention relates to reducing ink leakage when such a container is opened under atmospheric conditions different from the conditions under which the container was filled.

In different types of printing, such as ink jet printing, drops of ink are ejected from nozzles in an ink jet printhead in a specified pattern to form an image on a print medium. Examples of ink jet printing include thermal ink jet and piezoelectric ink jet. Both of these printing technologies are well understood by those skilled in the art. In ink jet printing, the ink is supplied to the printhead from a ink supply system. For a liquid ink printer, the ink supply system often includes one or more liquid ink containers that store the ink in liquid form until it is delivered to the printhead. In certain applications, the ink container and the printhead are formed as a single unit. In other applications, the ink container is replaceable apart from the printhead.

Replaceable ink containers are typically filled with liquid ink at a manufacturing site and sealed against leakage. The filled ink container typically has some amount of air trapped within the container when it is sealed. The sealed container is then shipped to the end user. The end user unseals the container, and installs the container in a printer for use.

A recurring issue with liquid ink containers is that the atmospheric conditions at the end user's location may differ from the atmospheric conditions at the manufacturing site at which the ink container was filled. Such different atmospheric conditions may cause the pressure of the air trapped inside the ink container to be higher than the ambient pressure at the user's location. In such a circumstance, the higher pressure inside the ink container may cause ink to squirt from the container when the user unseals the ink container.

SUMMARY

A method of opening a liquid ink container that has a capillary chamber and a free fluid chamber includes lowering the pressure in the free fluid chamber by expanding the volume of the free fluid chamber. After lowering the pressure in the free fluid chamber, the method includes opening the capillary chamber to the ambient environment. In one particular implementation, expanding the volume of the free chamber comprises dislocating outward a portion of the wall of the free fluid chamber.

A fluid container includes a housing formed of a plurality of container walls, with a fluid port through one of the container walls. An expansion element for the housing comprises a deformable wall portion of one of the container walls. An opening element is attached to the deformable wall portion for moving the deformable wall portion from an inner position to an outer position to expand the interior volume of the housing. A seal covers the fluid port.

THE DRAWING

DETAILED DESCRIPTION

Figure 1:
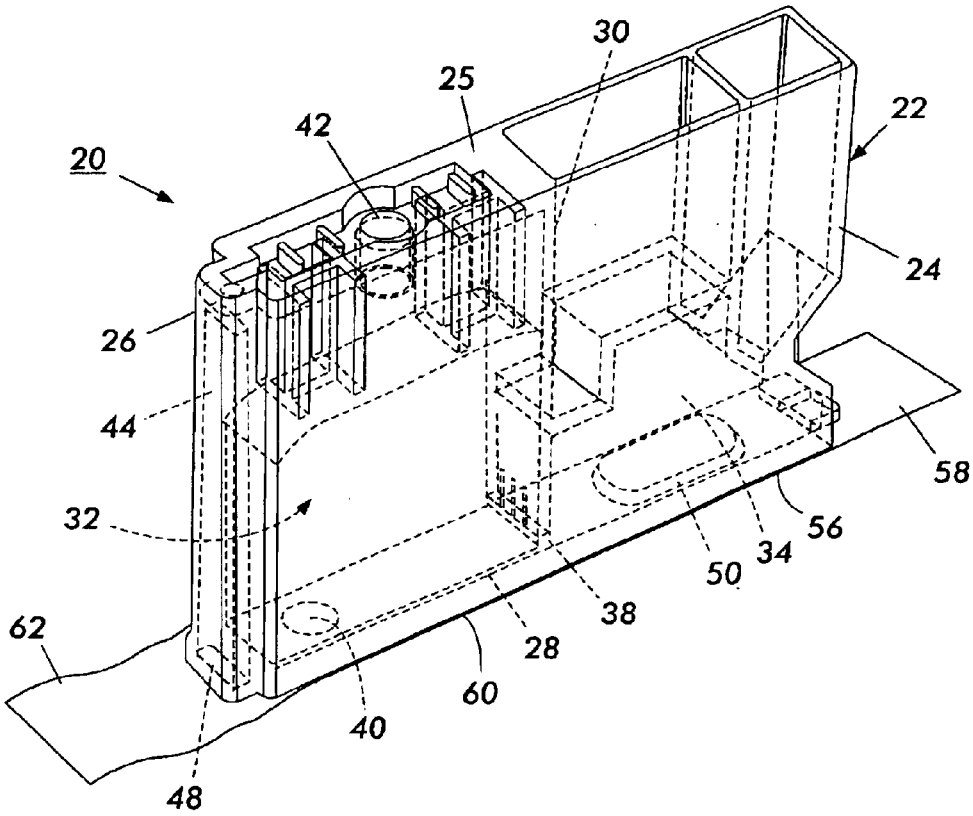
FIG. 1 is a perspective view of an exemplary ink container incorporating a particular embodiment of an expansion element, showing an internal structure thereof in phantom.
Figure 2:
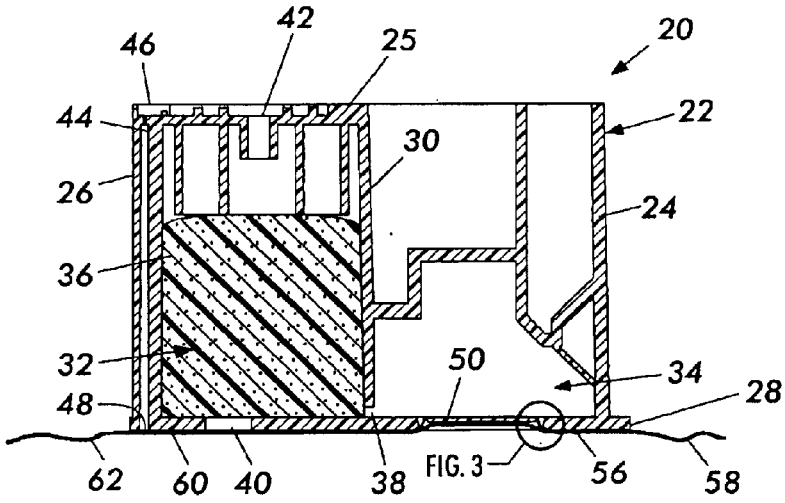
FIG. 2 is a side cross sectional view of the ink container of FIG. 1.

Referring to FIGS. 1 and 2, a fluid container 20, specifically an ink container for use with an ink jet printhead, such as a thermal ink jet printhead, includes a housing 22 formed of several external container walls 24, 25, 26, 28. One container wall 28 is referred herein as the bottom wall, although after reading the present description, those skilled in the art will recognize that aspects described herein with respect to the bottom wall can be applied to other walls of the container. In addition, although a rectangular shape is shown, other shapes may be used as dictated by the printhead into which the container is to be inserted.

A divider 30 extends from the top wall 25 toward the bottom wall 28 of the housing, dividing the interior of the housing into a capillary chamber 32 and a free fluid (ink) chamber 34. The capillary chamber in an ink container is filled with a capillary material 36 (FIG. 2), such as foam. The capillary material operates in a known manner when the ink container is installed in the printhead to maintain a slightly negative pressure at the printhead. A fluid conduit or opening 38 at or near the bottom of the divider allows for fluid flow between the capillary chamber and the free fluid chamber.

A fluid port 40 through an external container wall of the capillary chamber 32 provides a path for a printhead to draw ink from the capillary chamber when the ink container is installed in a printhead. The illustrated embodiment shows the fluid port 40 through the bottom wall 28 of the ink container. Those familiar with the art will recognize that such a fluid port can also be included in one of the side container walls, preferably near the bottom of the capillary chamber. A vent opening 42 at or near the top of the capillary chamber provides access to the upper portion of the capillary chamber.

Much of the structure of the ink container of FIGS. 1 and 2 is shown and described in U.S. Pat. No. 6,250,749 B1, issued Jun. 26, 2001 to Merz et al, the contents of which are hereby incorporated by reference. The illustrated internal structure is exemplary only. Numerous other arrangements of the particular walls forming the chambers of the fluid container can be used to provide different internal and external shapes, and to provide different fluid capacities for the container. For example, the free ink chamber is shown with a top wall lower than the top wall of the capillary chamber. However, the top wall of the free ink chamber can be at the same height as the top wall of the capillary chamber.

As described more fully in U.S. Pat. No. 6,250,749 B1, a seal 46 is applied over the top of the fluid container, so that the only air access to the capillary chamber upper vent 42 is through a vent conduit 44 extending from near the top of the container to an external vent conduit opening 48 near the fluid port at the bottom of the container. The seal 46 is not shown in FIG. 1.

Figure 4:
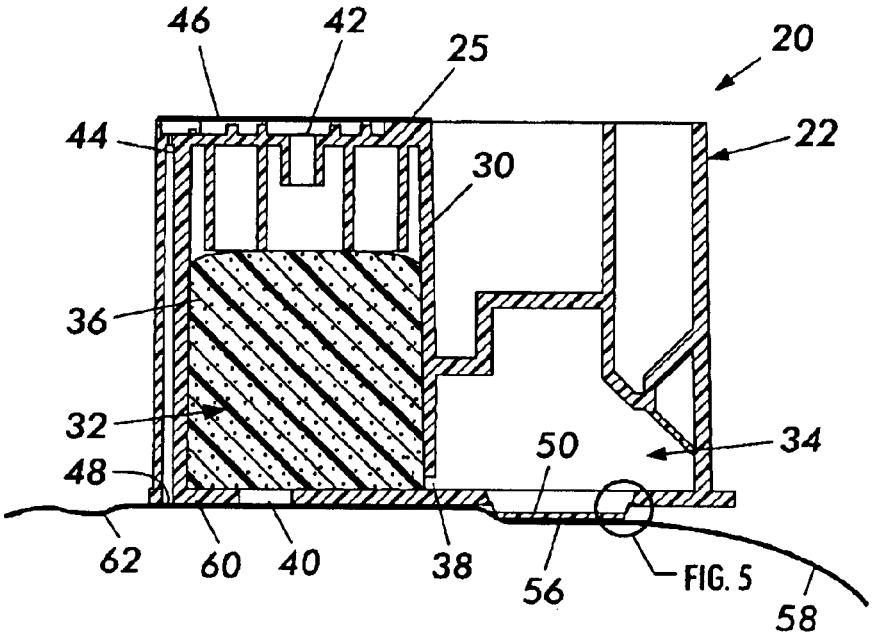
FIG. 4 is a cross sectional view of the ink container of FIG. 2 at a different stage of an opening process.

One of the exterior container walls (the bottom container wall 28 in the illustrated implementation) includes an expansion element 50 to selectively increase the interior volume of the free fluid chamber 34. The expansion element 50 is formed of a deformable portion of the exterior wall 28 of the container. This deformable wall portion is movable from an inner wall position (as shown in FIG. 2) to an outer wall position (as shown in FIG. 4).

The deformable wall portion is a thin membrane of semi-rigid material, such as plastic. Materials suitable for such a deformable membrane are widely available, and are used for many purposes. One such use is as lids for beverage cups having deformable segments used to identify the type of beverage in the cup. The deformable wall portion 50 of the ink container may be formed of a uniform thickness. Alternatively, as shown in the close up view of FIG. 3, the deformable wall portion may include a relatively thicker central segment 52 surrounded by a thinner perimeter segment 54 connecting the central segment with the surrounding wall. The perimeter segment 54 forms a type of hinge for the deformable wall portion.

Figure 3:
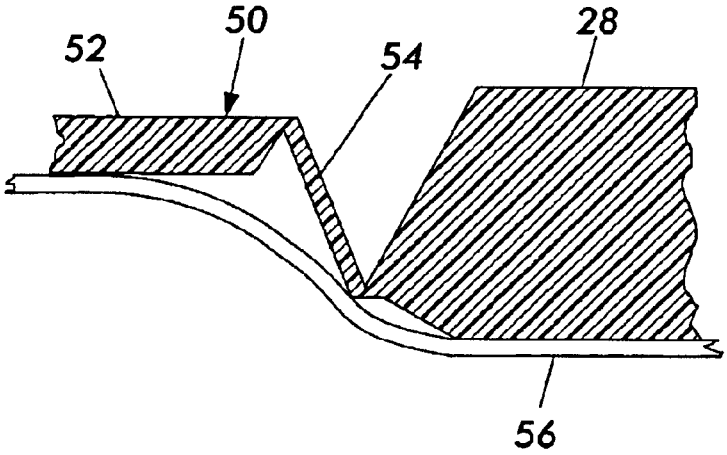
FIG. 3 is an enlarged partial cross sectional view of a portion of a wall of the container of FIGS. 1 and 2.

When the ink container 20 is initially filled at the point of manufacture, the deformable wall portion 50 is in the inner position, as shown in FIGS. 2 and 3. In this inner position, the deformable wall portion is deformed toward the interior of the ink container. An opening element, such as a sealing tape 56, is secured to the central section of the deformable wall portion. This sealing tape extends beyond the end of the container wall to provide a free end 58 for a user to grasp.

Figure 5:
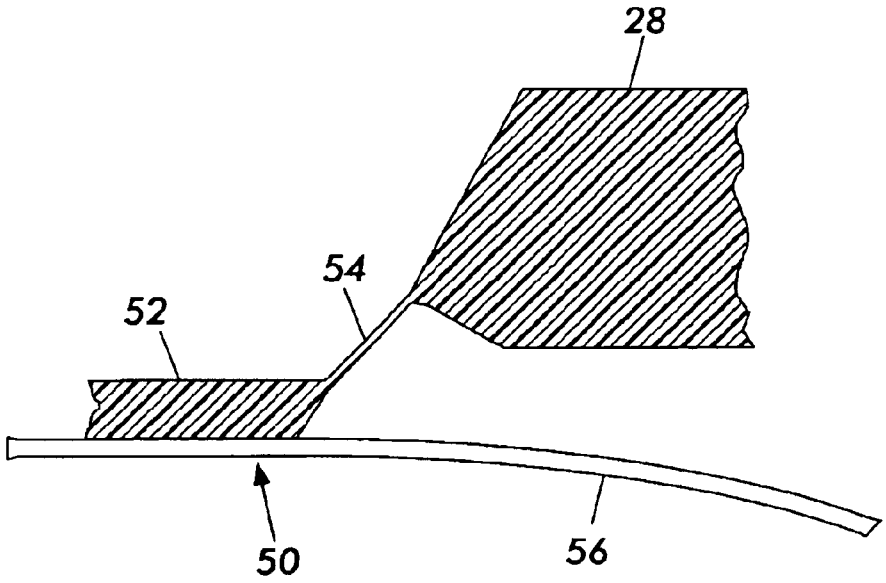
FIG. 5 is an enlarged partial cross sectional view of a wall of the ink container of FIG. 4.

When the user is prepared to use the ink container and install the ink container in a printhead of an ink jet printer, the user grasps the free end 58 of the opening element tape, and pulls the tape 56 away from the container wall 28. The adhesive attaching the opening element tape 56 to the central segment 52 of the deformable wall portion is sufficiently strong that as the user pulls the tape, the tape dislocates the deformable wall portion from its inner position to its outer position, as shown in FIGS. 4 and 5. In the outer position, the deformable wall portion is dislocated toward the exterior of the container. This movement of the deformable wall portion from its inner position to its outer position expands the volume of the free ink chamber 34. So expanding the volume of the free ink chamber lowers the pressure of the air and/or other gases in the free ink chamber. With the reduced gas pressure in the free ink chamber, some ink will tend to migrate from the capillary chamber 32 to the free ink chamber 34 through the fluid opening 38. The ink that tends to make such a migration tends to be ink in the capillary material adjacent the bottom container wall 28. This ink migration reduces the quantity of ink in the capillary material adjacent the fluid outlet port 40, and also reduces the pressure of air and/or other gases in the capillary chamber 32.

Figure 6:
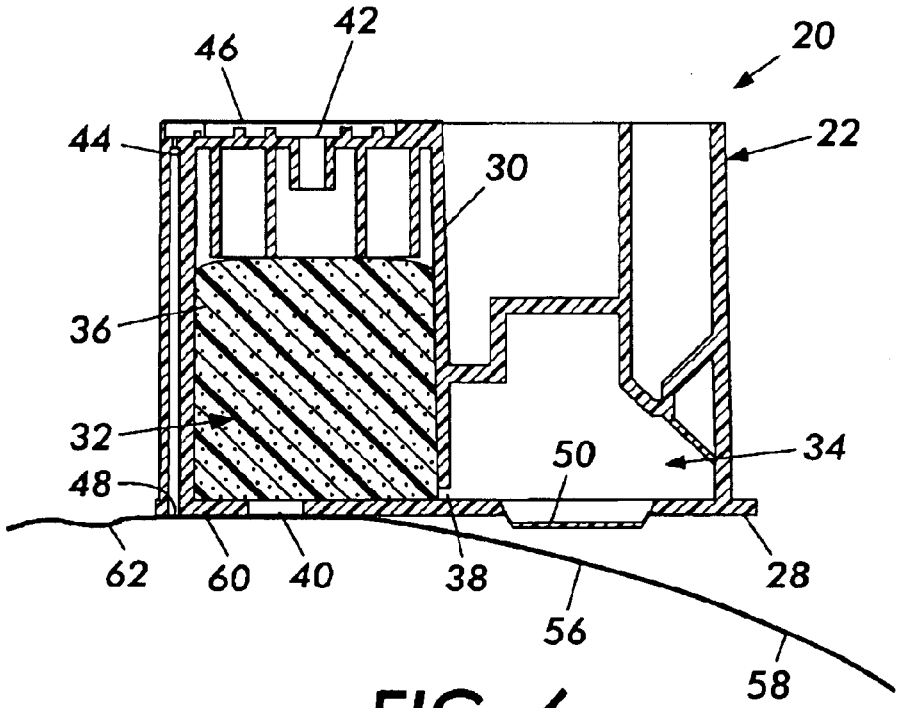
FIG. 6 is a cross sectional side view of the ink container of FIG. 2 at yet another stage of the opening process.

The user can continue to pull the opening element tape away from the bottom container wall. Depending on the strength of the bond between the opening element tape 56 and the central segment 52 of the deformable wall portion, the tape may separate from the deformable wall portion, as shown in FIG. 6. Alternatively, once the user has dislocated the deformable wall portion from its inner position to its outer position, the user can leave the opening tape element 56 attached to the deformable wall portion 50.

Figure 7:
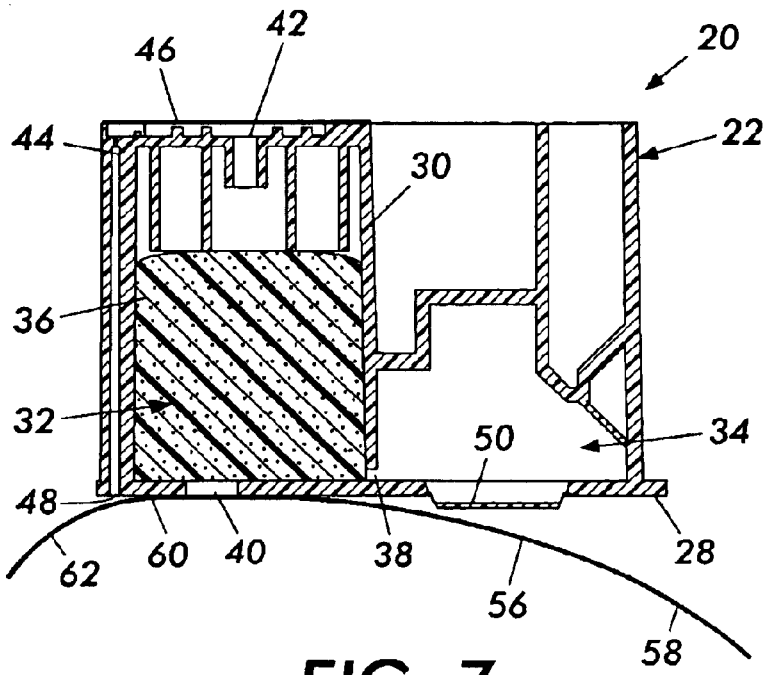
FIG. 7 is a cross sectional view of the ink container of FIG. 2 at yet another stage of the opening process.

After the user has expanded the volume of the free ink chamber, the user then opens the vent opening 42 into the upper portion of the capillary chamber 32. In the illustrated example, the user does so by pulling on a free end 62 of a port sealing tape 60 that covers the vent conduit opening 48, as shown in FIG. 7. The port sealing tape 60 can be another segment of the same tape used as the opening element 56 for the deformable wall portion, or it can be a separate piece of tape. A separate piece of tape for the port sealing tape 60 sealing the vent opening 40 may be particularly beneficial if the vent conduit opening 48 and/or the fluid port 40 are on a different container wall than the deformable wall portion forming the expansion element. The port sealing tape 60 is impermeable to the fluid (ink) in the container. The user pulls the port sealing tape 60 away from the bottom container wall 28 to open the vent conduit opening 48. So opening the vent conduit opening, and thus the vent conduit 44 and the vent 42 in the capillary chamber, to the ambient atmosphere equalizes the pressure in the capillary chamber 32 and the ambient environment. Because of the earlier operation of the expansion element 50, the overall pressure in the capillary chamber is lower than it otherwise would be. Such lower pressure reduces the possibility of ink leakage through the vent opening 42.

Figure 8:
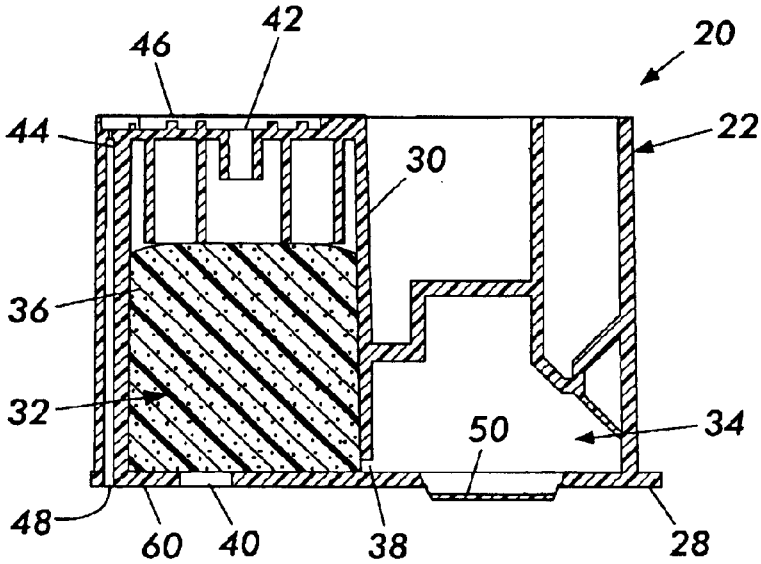
FIG. 8 is a cross sectional view of the ink container of FIG. 2 at a final stage of the opening process.

After opening the vent conduit opening 48, the user than opens the seal covering the fluid port 40 away from the container wall 28, opening the fluid port to communicate with the ambient environment. In the illustrated embodiment, the port seal is a portion of the port sealing tape 60. The reductions in pressure provided by the expansion of the expansion element 50, and the opening of the vent 42, place the pressure in the interior of the fluid container at equilibrium with the ambient environment. With equal pressure in the interior of the fluid container and the ambient environment, and the negative pressure effects of the capillary foam 36, it is unlikely that fluid will be ejected from the fluid port 40 when the user removes the port seal 60 from the fluid port 40. In addition, because the earlier opening of the expansion element tends to draw ink from the area of the capillary material around the fluid port, less fluid or ink is contained in the capillary material around the fluid port to be ejected, or to come into contact with the user's fingers or other objects near the fluid port. The user can completely remove the sealing tape 60 from the bottom wall 28 of the container, as shown in FIG. 8. In some implementations, the printhead may puncture the port seal 60 at the fluid port 40 when the user inserts the container into the printhead. In such implementations, the user does not remove the port seal 60 from the fluid port. The operation of the expansion element 50 and the opening of the vent 42 still reduces the possibility that a pressure differential will cause ink to be ejected from the ink container when the printer punctures the seal 60.

Figure 9:
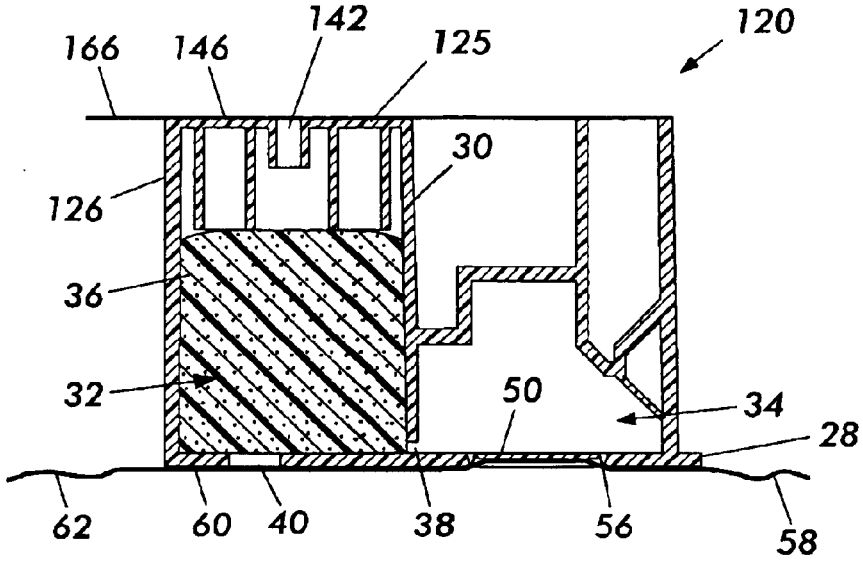
FIG. 9 is a cross sectional view of an ink container incorporating a different embodiment of an expansion element.

FIG. 9 shown an alternative embodiment of a fluid container 120 in which a vent 142 in the upper portion of the capillary chamber does not lead to a vent conduit extending down along one side wall of the container. The container top wall 125 and side wall 126 do not contain a vent conduit such as the vent conduit 44 of the embodiment shown in FIGS. 1–8. The top sealing tape 146 seals the vent opening 142. To open the fluid container shown in FIG. 9, the user first holds the free end 58 of the opening element tape 56 to expand the expansion element 50, thereby increasing the volume of the free fluid chamber as described above. The user then pulls a free end 166 of the vent sealing tape 146 away from the upper wall 125 of the fluid container to open the vent opening 142, and thus open the capillary chamber to the ambient. Finally, the user pulls the free end 62 of the fluid port seal 60 to open the fluid port 40.

Figure 10:
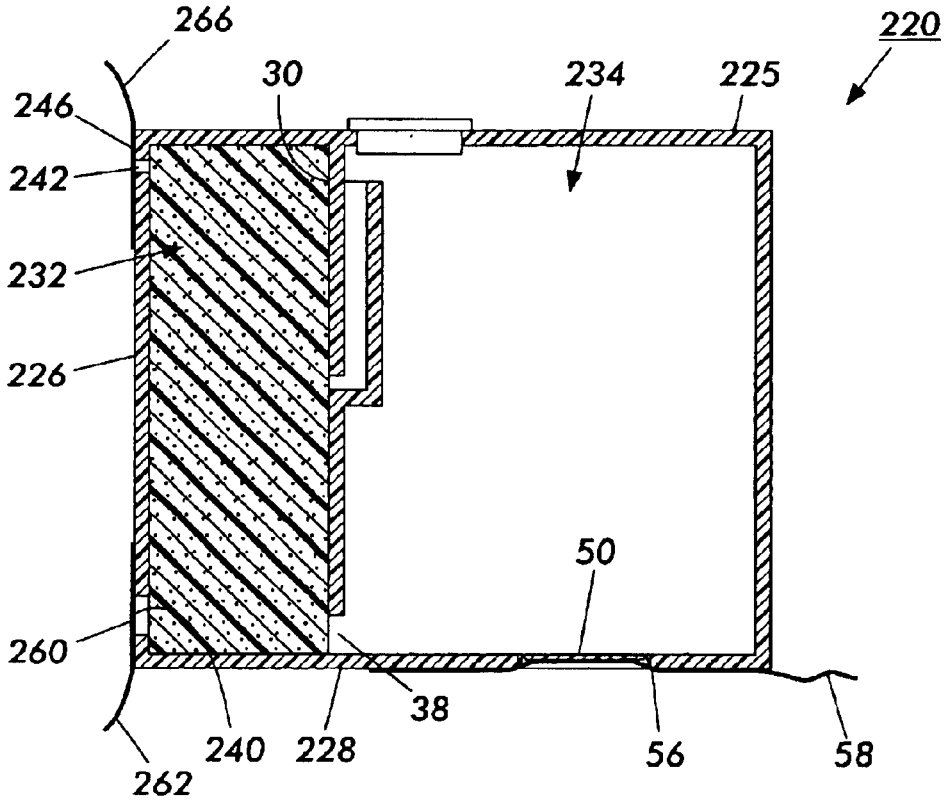
FIG. 10 is a cross sectional view of an ink container incorporating yet a different embodiment of an expansion element.
Figure 11:
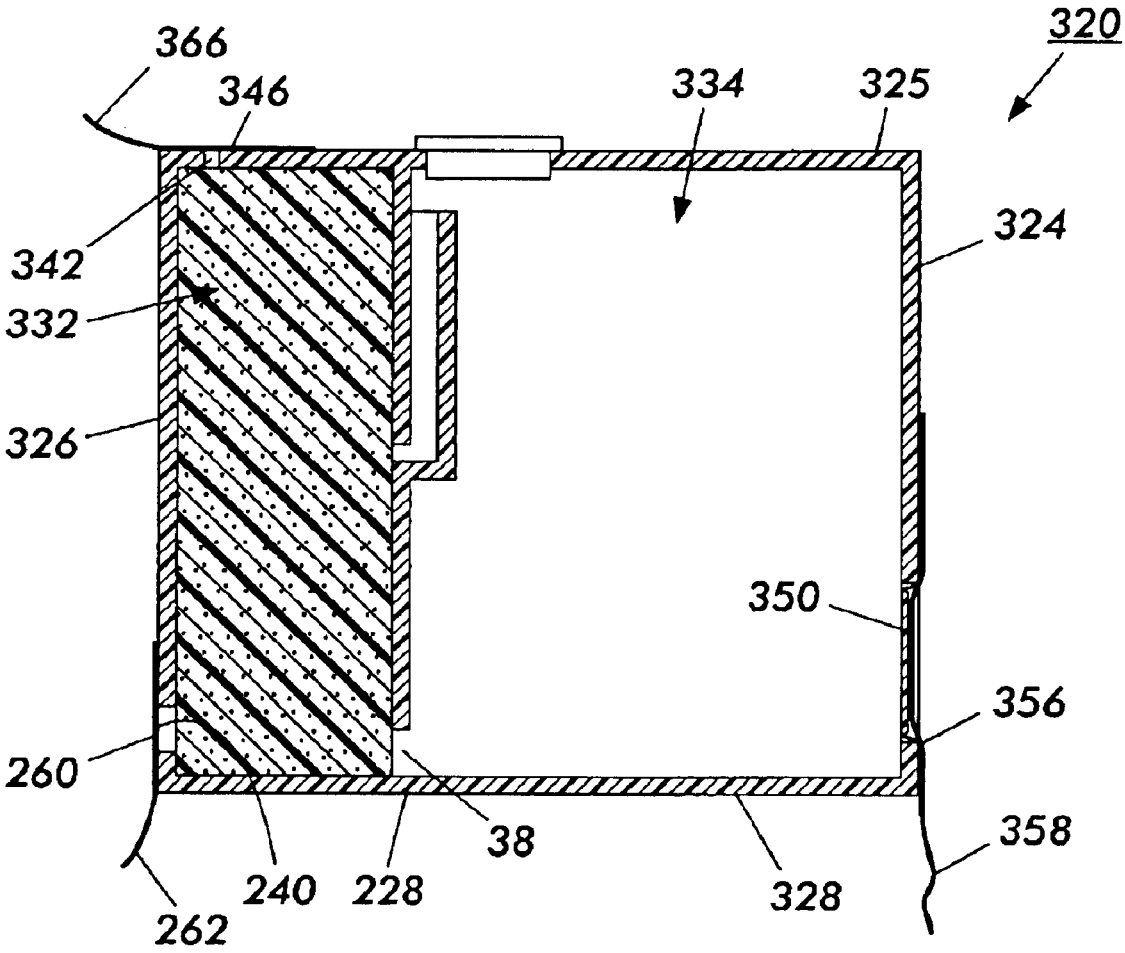
FIG. 11 is a cross sectional view of an ink container incorporating yet another different embodiment of an expansion element.

FIG. 10 shows an embodiment of a fluid container 220 in which the container wall 226 containing the fluid port 240 is different from the container wall 228 having the expansion element 50. The vent 242 for the capillary chamber is shown on the same wall 226 as the outlet port 240. However, as shown in the embodiment of FIG. 11, the 342 vent can be on a different wall, such as the top wall 225 of the container. Referring again to the implementation shown in FIG. 10, the fluid port sealing tape 260 is separate from the opening element tape 56 used to move the deformable wall portion of the expansion element 50. Vent sealing tape 246 closing the vent 242 is shown as separate from the fluid port seal 260. However, the same tape can extend along the container wall 226 to seal both the vent 242 and the fluid port 240.

To open the container shown in FIG. 10, the user first grasps the free end 58 of the opening element tape 56 and pulls the opening element tape away from the outer container wall 228. The opening element tape is attached to the central segment of the deformable wall portion forming the expansion element 50. Pulling the opening element tape 56 moves the deformable wall portion from its inner position (shown) to its outer position (not shown), thereby enlarging the volume of the free fluid chamber 234 of the container. So enlarging the free fluid chamber of the container lowers the pressure of the air or other gases in that chamber, drawing some ink from the capillary material in the capillary chamber 232 into the free fluid chamber 234. The user then opens the vent 242 in the capillary chamber to equalize the pressure in the interior of the container with the ambient atmospheric conditions. The user opens the vent 242 by pulling the free end 266 of the vent sealing tape 246 to remove the vent sealing tape from the vent 242. With the internal and external pressures of the container equalized, the user then pulls the free end 262 of the port seal 260 away from the container wall 226 to open the fluid port 240. Again, in some implementations, rather than removing the seal from the fluid port, the user inserts the container into the printer, and the printer punctures or otherwise opens the seal.

FIG. 11 shows an ink container 320 having additional variations on elements implementing aspects of the present invention. The ink container of FIG. 11 has an expansion element 350 formed as a deformable wall portion of one of the container walls 324 other than the bottom container wall 328. A vent opening 342 is in a container wall 325 different from the container wall 326 having the fluid port 240.

To open the container shown in FIG. 11, the user first grasps the free end 358 of the opening element tape 356 and pulls the opening element tape away from the outer container wall 324. The opening element tape is attached to the central segment of the deformable wall portion forming the expansion element 350. Therefore, pulling the opening element tape 56 moves the deformable wall portion from its inner position to its outer position (not shown), thereby enlarging the volume of the free fluid chamber 334 of the container. So enlarging the free fluid chamber of the container lowers the pressure of the air or other gases in that chamber, drawing some fluid ink from the capillary material in the capillary chamber 332 into the free fluid chamber 334. The user then equalizes the pressure in the interior of the container with the ambient atmospheric condition by opening the vent 342 in the capillary chamber. The user opens the vent 342 by pulling the free end 366 of the vent sealing tape 346 to remove the vent sealing tape from the vent 342. With the internal and external pressures of the container equalized, the user then pulls the free end 262 of the port seal 260 away from the container wall 326 to open the fluid port 240. Again, in some implementations, rather than removing the seal from the fluid port, the user inserts the container into the printer, and the printer punctures or otherwise opens the seal.

After reading the above descriptions, those skilled in the art will recognize that various modifications can be made to the implementations described above without departing from the spirit of the invention. Therefore, the invention as defined in the following claims is not to be limited to the particular implementations described above. For example, those skilled in the art will recognize that other shapes for the expansion element may be provided, and that the expansion element can be placed on different ones of the container walls. The expansion element can be implemented in other shapes. Other devices for expanding the expansion element may include a molded tab for the user to grasp, or other mechanism. In addition, numerous other combinations of placement of the expansion element, the vent opening, and the fluid port are possible. Furthermore, in certain implementations, the vent through the capillary chamber may not be essential to the operation of the device.

I claim:

1. A method of opening a fluid container, the fluid container having a capillary chamber and a free fluid chamber, the method comprising:

dislocating outward a deformable wall portion of an outer wall of the fluid container to expand the volume of the free fluid chamber;

after dislocating the deformable wall portion, opening a vent opening in an upper portion of the capillary chamber; and after opening the vent opening, opening a fluid port in a lower portion of the capillary chamber.

2. The method of claim 1, wherein dislocating outward a portion of the outer wall of the container comprises moving the deformable wall portion from an inner position to an outer position.

3. The method of claim 2, wherein moving the deformable wall portion from the inner position to the outer position comprises pulling a first tape segment attached to the deformable wall portion.

4. A method of opening an ink container, the method comprising:

lowering a pressure in an interior of the container; and after lowering the pressure in the container interior, opening the container interior to the ambient environment;

wherein lowering the pressure in the interior comprises expanding an interior volume of the container.

5. The method of claim 4, wherein expanding the interior volume of the container comprises dislocating a deformable wall portion from an inner position to an outer position.

6. The method of claim 5, wherein:

the ink container has a capillary chamber and a free ink chamber in fluid communication with one another; and lowering the pressure in the container comprises lowering the pressure in the free ink chamber.

7. The method of claim 6, wherein opening the container interior to the ambient comprises opening the capillary chamber to the ambient environment.

8. The method of claim 7, wherein opening the capillary chamber to the ambient comprises:

opening an air vent in the capillary chamber; and opening an ink port in the capillary chamber.

9. The method of claim 8, wherein the air vent is opened before the ink port is opened.

10. The method of claim 5, wherein opening the interior of the container to the ambient comprises opening the capillary chamber to the ambient environment comprises:

opening a vent in an upper portion of the capillary chamber to the ambient environment; and after opening the vent, opening an ink port through an outer wall of a lower portion of the container.

11. A fluid container comprising:

a plurality of container walls forming a housing;

a fluid port through one of the container walls;

an expansion element comprising a deformable wall portion of one of the container walls;

an opening element attached to the deformable wall portion for moving the deformable wail portion from an inner position to an outer position;

a seal closing the fluid port.

12. The fluid container of claim 11, additionally comprising a vent though one of the container walls.

13. The fluid container of claim 12, wherein:

the fluid port is through a lower portion of one of the container walls; and the vent is through an upper portion of one of the container walls.

14. A liquid ink container comprising:

a plurality of exterior container walls forming a housing having a housing interior;

a divider dividing the housing interior into a capillary chamber and a free ink chamber;

a conduit through the divider to fluidly connect the capillary chamber and the free ink chamber;

an ink port through a first one of the exterior container walls into the capillary chamber;

a removable seal closing the ink port;

a vent through a second one of the exterior container walls into the capillary chamber;

an expansion element formed as a deformable portion of a third one of the exterior container walls at the free ink chamber;

wherein the expansion element has an inner position in which the deformable wall portion is deformed toward the interior of the housing, and an outer position in which the deformable wall portion is deformed toward the exterior of the housing; and an opening element attached to the deformable portion of the third exterior container wall for selectively moving the expansion element from its inner position to its outer position.

15. The liquid ink container of claim 14, wherein the deformable wall portion comprises a central wall segment surrounded by a hinged portion.

16. The liquid ink container of claim 15, wherein the central wall segment is attached to the opening element.

17. The liquid ink container of claim 16, wherein the opening element comprises tape adhered to the central wall segment.

18. The liquid ink container of claim 14, wherein the third exterior container wall having the deformable portion is an extension of the first exterior wall having the ink port.

19. The liquid ink container of claim 14, wherein the opening element is attached to the seal so that the opening element moves the expansion element from its inner position to its outer position before the seal opens the ink port.

* * * * *